US011661265B2

(12) United States Patent
Gaillard et al.

(10) Patent No.: US 11,661,265 B2
(45) **Date of Patent: *May 30, 2023**

(54) DISPENSER FOR A PRESSURIZED CONTAINER

(71) Applicant: LINDAL FRANCE (SAS), Val-de-Briey (FR)

(72) Inventors: Eric Gaillard, Dieue-sur-Meuse (FR); Hervé Bodet, Verdun (FR)

(73) Assignee: LINDAL FRANCE (SAS), Val-de-Briey (FR)

( * ) Notice: Subject to any disclaimer, the term of this patent is extended or adjusted under 35 U.S.C. 154(b) by 0 days.

This patent is subject to a terminal disclaimer.

(21) Appl. No.: 17/423,963

(22) PCT Filed: Jan. 21, 2020

(86) PCT No.: PCT/EP2020/051335

§ 371 (c)(1),
(2) Date: Jul. 19, 2021

(87) PCT Pub. No.: WO2020/152125

PCT Pub. Date: Jul. 30, 2020

(65) Prior Publication Data

US 2022/0081187 A1 Mar. 17, 2022

(30) Foreign Application Priority Data

Jan. 25, 2019 (FR) ..... 1900676

(51) Int. Cl.
*B65D 83/20* (2006.01)
*B65D 83/14* (2006.01)
(Continued)

(52) U.S. Cl.
CPC ..... *B65D 83/206* (2013.01); *B65D 83/205* (2013.01); *B65D 83/48* (2013.01); *B65D 83/753* (2013.01); *B65D 83/28* (2013.01)

(58) Field of Classification Search
CPC .... B65D 83/206; B65D 83/205; B65D 83/48; B65D 83/753; B65D 83/28
See application file for complete search history.

(56) References Cited

U.S. PATENT DOCUMENTS 4,328,911 A 5/1982 Knickerbocker
4,416,399 A 11/1983 Parr et al.
(Continued)

FOREIGN PATENT DOCUMENTS

EP 3251753 A1 12/2017
FR 2429161 A1 1/1980
(Continued)

OTHER PUBLICATIONS

International Search Report and Written Opinion for the International Patent Application No. PCT/EP2020/051335, dated Apr. 23, 2020, 13 pages [translation of ISR included, 2 pages].
(Continued)

*Primary Examiner* — Bob Zadeh
(74) *Attorney, Agent, or Firm* — KDW Firm PLLC

(57) ABSTRACT

A dispenser for a pressurised container provided with a valve, provided with: a base body having a finger tab which can be actuated by the user in order to actuate the valve, and having an output opening intended for the output of the product of the container. An outlet pipe, placed in the base body, has a passage between a first end configured to cooperate with the valve of the container, and a second end configured for the output of the product and corresponding with the outlet opening. The base body includes a connection hole remote from the outlet opening. The connection hole passes between an outer surface and an inner surface of the base body and is configured to facilitate a fastening of the outlet pipe so that the outlet pipe can be hooked to the base body.

16 Claims, 5 Drawing Sheets

(51) Int. Cl.
*B65D 83/48* (2006.01)
*B65D 83/28* (2006.01)

(56) References Cited

U.S. PATENT DOCUMENTS

| | | | | |
|---|---|---|---|---|
| 4,815,541 | A | 3/1989 | Arrington | |
| 7,789,278 | B2 * | 9/2010 | Ruiz de Gopegui | B05B 7/2435 222/402.18 |
| 9,382,059 | B2 * | 7/2016 | Selinger | B65D 83/206 |
| 10,064,472 | B2 | 9/2018 | Campbell et al. | |
| 2002/0108972 | A1 | 8/2002 | Bayer | |
| 2003/0089734 | A1 * | 5/2003 | Eberhardt | B65D 83/75 222/402.1 |
| 2004/0245294 | A1 | 12/2004 | Mineau et al. | |
| 2007/0051754 | A1 * | 3/2007 | Strand | B65D 83/206 222/402.13 |
| 2007/0290007 | A1 * | 12/2007 | Eberhardt | B65D 83/206 239/577 |
| 2008/0164345 | A1 * | 7/2008 | Belau | B65D 83/206 222/402.13 |
| 2008/0221561 | A1 * | 9/2008 | Geiger | B65D 83/206 606/22 |
| 2009/0321381 | A1 * | 12/2009 | Paas | B65D 83/201 215/316 |
| 2010/0147898 | A1 * | 6/2010 | Blumenstein | B65D 83/206 222/402.13 |
| 2015/0014368 | A1 * | 1/2015 | Greiner-Perth | A61M 15/009 222/402.13 |
| 2015/0050425 | A1 * | 2/2015 | Hanson | B65D 83/206 239/337 |
| 2015/0251202 | A1 | 9/2015 | Ogata et al. | |
| 2016/0221744 | A1 | 8/2016 | Coppus et al. | |
| 2017/0233171 | A1 | 8/2017 | Christianson et al. | |
| 2018/0118444 | A1 | 5/2018 | Bodet et al. | |
| 2020/0062489 | A1 | 2/2020 | Spang, Jr. et al. | |

FOREIGN PATENT DOCUMENTS

| | | | | |
|---|---|---|---|---|
| FR | 2556242 | A1 * | 6/1985 | B65D 83/206 |
| FR | 2556242 | A1 | 6/1985 | |
| FR | 2881721 | A1 | 8/2006 | |
| WO | WO-2011111244 | A1 * | 9/2011 | B65D 47/268 |

OTHER PUBLICATIONS

International Search Report and Written Opinion for the International Patent Application No. PCT/EP2020/051336, dated Apr. 22, 2020, 11 pages [translation of ISR included, 2 pages].

International Search Report and Written Opinion for the International Patent Application No. PCT/EP2020/051337, dated Apr. 17, 2020, 11 pages [translation of ISR included, 2 pages].

* cited by examiner

DISPENSER FOR A PRESSURIZED CONTAINER

This is a national stage application filed under 35 U.S.C. § 371 of pending international application PCT/EP2020/051335, filed Jan. 21, 2020, which claims priority to French Patent Application No. FR 1900676, filed Jan. 25, 2019, the entirety of which applications are hereby incorporated by reference herein.

FIELD OF THE INVENTION

The present invention relates to a diffuser for a pressurized container fitted with a valve, especially for an aerosol generator, and more particularly to a diffuser with several assembled parts.

BACKGROUND OF THE INVENTION

Generally, a diffuser consists of two main parts having distinct functions and injected in a single material. These two parts are the outlet duct, the functions of which are to guide the product contained in the pressurized container from the valve and to dispense this product, and the base body which protects the outlet duct and which comprises elements to actuate the outlet duct for the release of the product. The diffuser can be moulded in one single piece or have injected parts in one material, optionally in two different colours, which are mechanically snapped together. Thus, depending on the container, on the commercial distributor of the finished item, and on the product in the container, the design of the diffuser has to be completely reworked for each new variation, and production lines adapted accordingly. Consequently, these additional design and production costs are reflected in the cost of each diffuser produced. Thus, there is a need for a diffuser which can have lower cost variations.

There are already some diffusers with parts which, before assembly, are initially separate and then put together, e.g. mechanically, by bonding or thermal welding, or which are produced by co-injection moulding. However, these diffusers require their various parts to be completely redesigned and the production lines readapted for each possible diffuser variant. Even if there is a possibility of using some of the separately made parts in other parts of the diffuser, all these additional design and manufacture costs are not sufficiently reduced. Therefore, it is necessary to have a diffuser which can more easily be adapted for different variations in order to limit additional costs.

DISCLOSURE OF THE INVENTION

The purpose of the invention is to provide a diffuser whose various parts can be assembled in a way that permits cost-effective variations between different diffusers, whilst retaining as much design flexibility as possible between the different variations.

According to the first aspect of the invention, there is provided a diffuser for a pressurized container fitted with a valve, especially for an aerosol generator. The diffuser comprises a base body and an outlet duct. The base body includes a finger tab to be depressed by the user in order to actuate the valve, and includes an outlet opening for the release of the product contained in the container. The outlet duct is placed in the base body and has a passage between a first end and a second end. The first end is configured to cooperate with the pressurized container's valve. The second end is configured for the release of the product contained in the pressurized container, and to correspond with the outlet opening of the base body. The base body comprises a connecting hole at a distance from the outlet opening. The connecting hole is a through hole between an outer surface of the base body and an inner surface of the base body, and is configured to facilitate an attachment of the outlet duct in such a way that the outlet duct can be fastened to the base body.

The embodiments of the invention are based inter alia on the inventive idea that the part which generates a large number of constraints, and therefore costs, during the design of a new variation of the diffuser is the connection between the base body and the outlet duct. Indeed, whenever there is a new specific model for the base body, the outlet duct has to be configured to connect at a certain part of the base body, and thus has to be completely redesigned. Conversely, if there is a new specific model for the outlet duct, the base body and the elements needed to actuate the outlet duct have to be configured so that they are connected in a manner allowing the product contained in the container to be released correctly, and thus they have to be completely redesigned.

The permanent presence of a connecting hole in one part of the base body design offers an ongoing means of attaching the outlet duct to the base body for all diffuser variations. The connecting hole serves to facilitate the attaching of the outlet duct to the base body. For example, it can be used to introduce a means of attachment which may be mechanical, glue or adhesive, welding, or a tool to allow the outlet duct to be fixed to the base body. As just one connecting hole is required at a given position on the base body, the design flexibility between different diffuser variations is preserved.

Additionally, as the connecting hole is a through hole, the outlet duct can be attached by manipulating the outlet duct and the base body from outside the base body and/or by minimal manipulation from inside. The attachment of the outlet duct to the base body is therefore not unduly complex, and thus gives a cost-effective solution.

In a typical embodiment, the outlet duct could be available in a small number of so-called standard variants, e.g., one variant with a nozzle, one without a nozzle, and the various base body designs could be made adaptable to fit the standard outlet ducts. Additionally, the dimensions of the outlet duct could be optimised to use as little material as possible. As for the base body material, it could be different from the outlet duct material, and/or it could be recycled, and/or from renewable resources and/or from cheaper resources.

In a preferred embodiment, the outlet duct and the base body are two separate parts, and the outlet duct, when attached to the base body, includes a portion which is inserted into the connecting hole.

In this manner, the two parts can be manufactured independently of each other in either compatible or non-compatible materials. In an exemplary embodiment, the variations of outlet duct are standardised and ready-made. All that is therefore required is to design one single part, the base body, in such a way as to give logistical flexibility and reduce costs.

The outlet duct can be attached to the base body by inserting a portion of the outlet duct into the connecting hole in such a way that it cannot come loose on its own. The inserted portion can be mechanically joined, welded, chemically bonded and/or heat-bonded to the base body. The connecting hole thus facilitates the attachment of the outlet duct and, by the insertion of the outlet duct portion, facilitates the positioning of the outlet duct in relation to the base body.

It should also be noted that because of the attachment between the outlet duct and the base body, these two parts of the diffuser can be manufactured from different materials. Thus, the outlet duct and the base body can also be manufactured with different textures, e.g., a 'soft touch' base body, and/or with different colours. The outlet duct material could be selected to be compatible with the product contained in the pressurized container, while the base body material might not need to satisfy this condition, but could instead be selected for its mechanical characteristics or its environmental and/or economic value, e.g., a recycled material. For example, if the diffuser is to be used for a food product, the material for the outlet duct would need to be of food grade quality, whilst this would not be required of the base body material as it does not come into contact with the product.

Depending on what fastening is used to attach the outlet duct to the base body, materials can be selected either to be compatible or not. Possible materials for the base body could include polymer materials (PE, PP, PLA, PHA, PBS), which could be either new or recycled, petroleum-based or from natural resources, biodegradable or not, including compostable or not. They could contain mineral fillers, e.g., basalt glass, and could be reinforced with mineral or vegetable fibres. Non-polymer materials, such as lignin-based materials, could also be considered, e.g., cardboard, wood, materials containing textiles, or metals, etc. As a non-limiting example, polymers (PE, PP, POM, PBT, PA, etc.), which are injectable materials, or machinable materials such as metals, e.g., aluminium, steel, and especially stainless steel, could be used for the outlet duct.

In an advantageous embodiment, the outlet duct is attached mechanically to the base body through the connecting hole.

In this way, it is simple to attach the outlet duct to the base body. Mechanical attachment can be achieved using an additional fastening element such as a screw or a rivet configured to hold the outlet duct to a wall of the base body. In another exemplary embodiment, mechanical attachment can be achieved by force fitting between a portion of the outlet duct and the connecting hole. In yet a further exemplary embodiment, mechanical attachment can be achieved by snapping the outlet duct and the base body together by force. Mechanical attachment may or may not be complemented by bonding, heat-bonding or welding.

In a preferred embodiment, the connecting hole is a through hole between an outer surface and an inner surface of the finger tab, preferably transversely to the outer surface and/or inner surface of the finger tab.

In this manner, the outlet duct can be directly connected to the finger tab, such that pressure on the finger tab is relayed effectively to the valve via the outlet duct in order to actuate the valve. The movements of the outlet duct can therefore be mechanically correlated to the movements of the finger tab.

The finger tab of a diffuser can be defined as the part of the diffuser directly subjected to a movement following pressure of a user's finger on a portion of the outer surface of the finger tab. The movement of the finger tab causes, generally mechanically, the movement of the outlet duct and the actuation of the valve of the pressurized container.

In an exemplary embodiment, the finger tab can be elastically connected to the rest of the base body, e.g., by a tongue, and the outlet duct joined directly to the finger tab by means of a portion inserted into the connecting through hole. The movements of the outlet duct will thus correspond to the movements of the finger tab. In other embodiments, the finger tab can be separate from the base body and can be depressed either in a vertical translational motion or in a rocking motion around a support.

In an advantageous embodiment, the outlet duct is fitted with a fastening lug in such a way that the fastening lug and the outlet duct are integrated with each other in one piece.

In this way, the means of attachment is mechanically simple and robust. By integrating the fastening lug with the outlet duct, the number of separate parts making up the diffuser is reduced. Depending on the type of fastening lug, the attachment of the outlet duct to the base body can be achieved by interlocking or by force, thus without requiring any additional element, or can be achieved with an additional fastening element. A newly designed variation of outlet duct may easily be effected by modifying the length of the fastening lug depending on the desired base body. Additionally, the section of the fastening lug may be designed to encourage the alignment and positioning of the outlet duct in relation to the base body, by cooperating with a section of the connecting hole.

In a preferred embodiment, the fastening lug comprises a rod, a shoulder, and a cap connected to the outlet duct by the rod, said rod ending, opposite the cap, with the shoulder.

In this manner, the fastening lug comprises one portion, the cap, which secures the outlet duct to the base body, without requiring any additional element to attach it to the base body. The shoulder and the cap may be configured in such a way that, when the outlet duct is fastened to the base body, a transverse extension of the shoulder is greater than the corresponding transverse extension of the connecting hole, and a transverse extension of the cap is greater than the corresponding transverse extension of the connecting hole. The rod may be configured so that it passes through the connecting hole. When force-fitting the outlet duct to the base body, the cap and the shoulder may be located on either side of a portion of the connecting hole, and the outlet duct will be fixed to the base body.

In an advantageous embodiment, the fastening lug is configured to cooperate with the connecting hole in such a way that, in a fastened state, the inner surface of the base body and the outer surface of the base body are placed between the fastening lug's cap and the fastening lug's shoulder.

In this way, the connecting hole is made through the actual wall of the base body. The moulding and manufacture of this structure are thus simplified. In addition, this minimises the length of the rod and thus the amount of material used.

In a preferred embodiment, the connecting hole is defined by a first portion and a second portion, said first portion being an internal portion leading to the inner surface of the base body, and said second portion being an external portion leading to the outer surface of the base body; and the first portion and second portion of the connecting hole are configured in such a way that, in a fastened state, the surface of the end of the fastening lug's cap is flush with the outer surface of the base body.

In this manner, the attachment of the outlet duct and the base body is more aesthetically pleasing because the outer surface of the finger tab punctuated by the surface of the end of the cap can be made continuous. Alternatively, the outer surface of the finger tab may have positive and/or negative reliefs and the end of the cap's surface may form part of these reliefs.

In an advantageous embodiment, the fastening lug comprises an asymmetrical or polyhedral cross-section; and the connecting hole comprises an asymmetrical or polyhedral cross-section corresponding to the asymmetrical or polyhedral cross-section of the fastening lug. The asymmetrical or polyhedral cross-sections of the fastening lug and the connecting hole can be selected such that, in a fastened state, any rotation of the outlet duct in relation to the base body is prevented.

In this way, the fastening lug and the connecting hole have dual functionality: as a fastening means and a guiding means for the outlet duct in relation to the base body.

In a preferred embodiment, the outlet duct has a hollow compartment between the fastening lug and the passage between the first end and the second end.

In this manner, the distance between the fastening lug and the passage can easily be adjusted depending on the profile of the base body, by modifying the dimensions of the hollow compartment. Additionally, as the compartment is hollow, only a small amount of material is used. In an exemplary embodiment, the hollow compartment has a parallelepiped shape to give it a simple and structurally rigid form. The hollow compartment can be part of the shoulder.

In an advantageous embodiment, the connecting hole is located on the front half of the finger tab as seen in the direction of flow of the product from the second end of the outlet duct, in a fastened state.

In this way, the distance between the connecting hole and the second end of the outlet duct is reduced, and the longitudinal dimensions of the outlet duct can be minimised in order to attach the outlet duct to the base body. In an exemplary embodiment, the finger tab is elastically connected to the base body and the connection is located at the back of the finger tab as seen in the direction of flow of the product from the second end of the outlet duct; attaching the outlet duct to the front of the finger tab can consequently be mechanically correlated to greater vertical movement of the finger tab than if it is attached to the back of the finger tab.

In a preferred embodiment, a portion of the connecting hole leading to the inner surface of the finger tab is configured to be coaxial with the pressurized container's valve.

In this manner, the portion connecting the outlet duct to the base body closest to the finger tab is aligned with the axis of the valve. Pressure on the finger tab, causing the finger tab to move along the axis of the valve, is more effectively transmitted to actuate the valve. Additionally, conversion of the pressure on the finger tab into transverse motion relative to the valve's axis is reduced, which causes less transverse bending at the outlet end of the valve.

In an advantageous embodiment, the second end of the outlet duct is floating in relation to the base body.

In this way, there are fewer connecting elements needed between the outlet duct and the base body, which means less material is required. In an exemplary embodiment, the second end of the outlet duct may face an oblong outlet opening extending through the base body, said outlet opening being configured for the release of the product from the second end of the outlet duct when the second end is moved in accordance with the valve's axis.

In a preferred embodiment, the base body consists of a wall which forms a cavity, said wall comprising a convex front surface as seen in the direction of flow of the product from the second end of the outlet duct, in a fastened state, said convex front surface including an outlet opening which corresponds with the second end of the outlet duct, in a fastened state.

In this manner, the outlet opening in the convex front surface of the base body is close to the valve axis, and the outlet duct's longitudinal dimensions can be minimised.

In an advantageous embodiment, the minimum distance between a first point, said first point being a point of the connecting hole on the outer surface of the finger tab, and a second point, said second point being a point of the outlet opening on the outer surface of the base body, is less than 12 mm, preferably less than 10 mm, and more preferably less than 8 mm.

In this way, an additional constraint is added to the design of the base body which ensures the outlet duct used has reduced dimensions, and thus the amount of material used is economically advantageous.

In a preferred embodiment, a portion of the fastening lug, in a fastened state, is visible from the outside of the diffuser, and has a recognisable shape and/or colour serving as a means of identification for the user.

In this manner, the fastening lug has the dual function of identification and fastening means. The shape and/or colour of the fastening lug may indicate a type of product, the origin of the product, usage precautions for the product, a conditioning of the product etc.

BRIEF DESCRIPTION OF THE FIGURES

These and other aspects of the present invention will now be described in more detail, with reference to the attached drawings which show examples of embodiments of the invention. Identical numbers refer to identical features in all the drawings.

DETAILED DESCRIPTION OF THE INVENTION

Figure 1A:
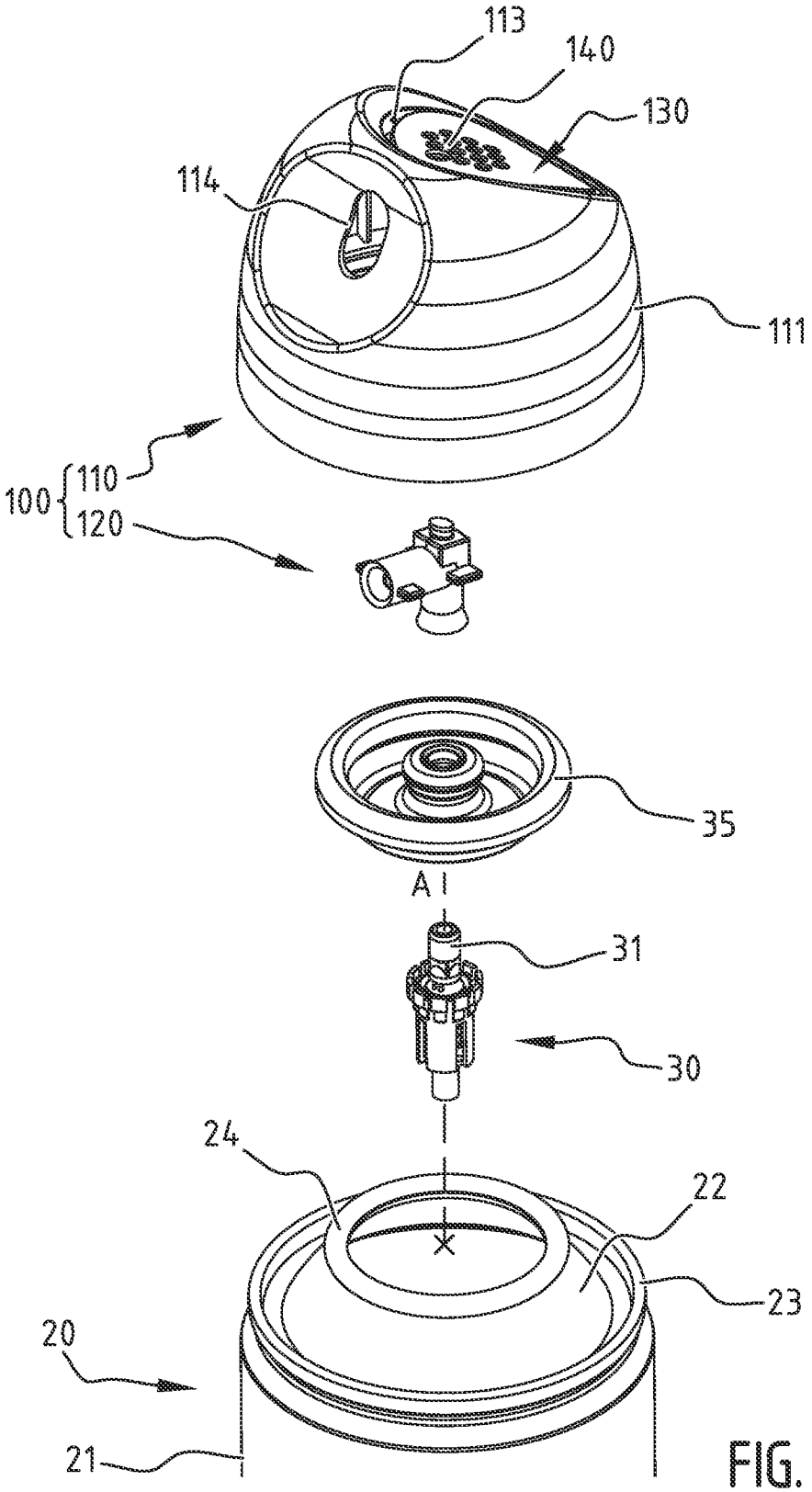
FIGS. 1A-1B show an exploded perspective view and a longitudinal cross-sectional perspective view, respectively, of the diffuser, the pressurized container's valve, and the pressurized container according to an embodiment of the invention.
Figure 1B:
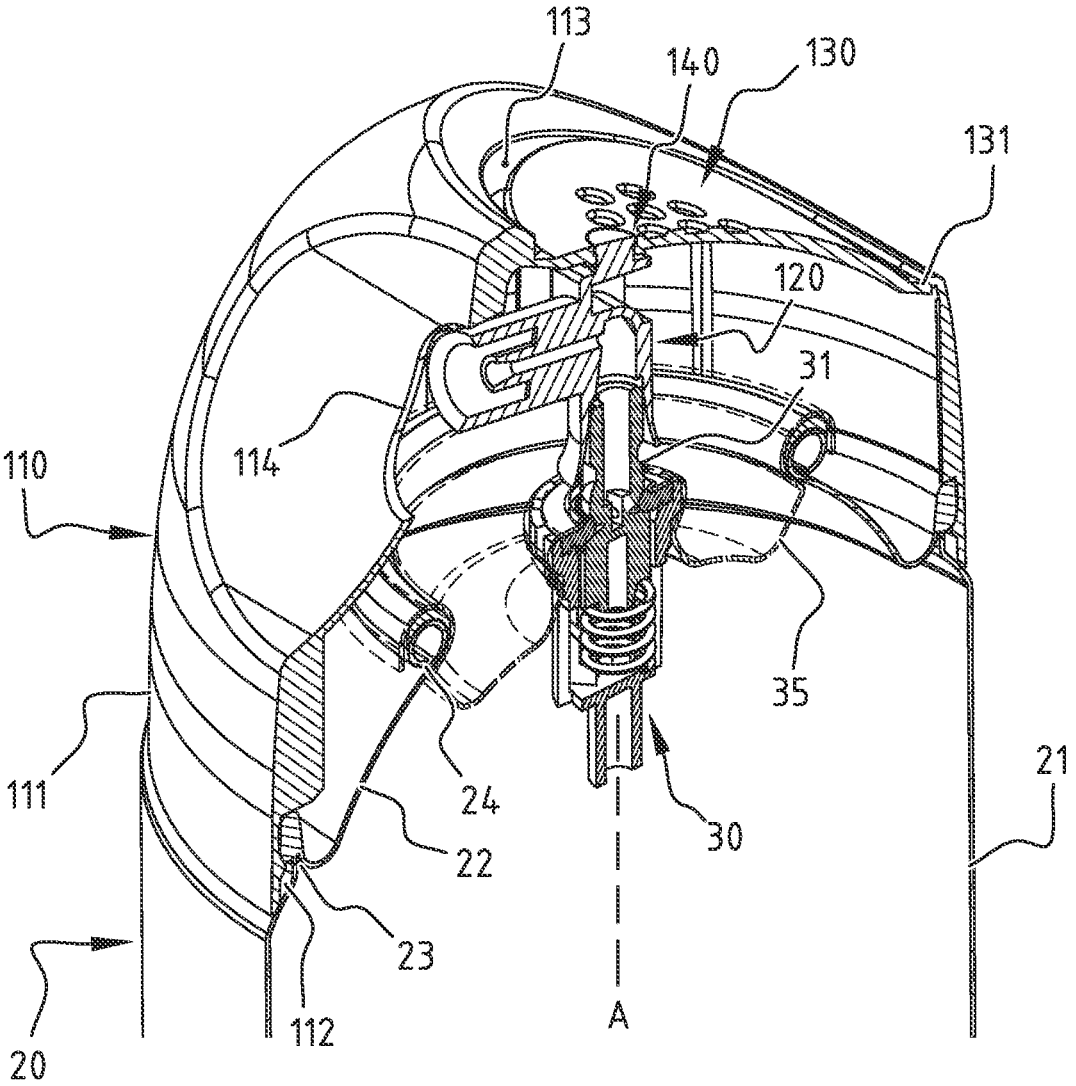

FIGS. 1A-1B show an exploded perspective view and a longitudinal cross-sectional perspective view, respectively, of the diffuser, the pressurized container's valve, and the pressurized container according to an exemplary embodiment of the invention. The invention relates to a diffuser 100 for a pressurized container 20, especially for an aerosol generator, a foam generator, a dispenser system for gel, cream or other paste or liquid products, etc. The diffuser 100 is used to actuate the valve 30 of the container in order to remove some of the contents from the pressurized container 20 and to dispense it in the form of an aerosol or foam, for example. Pressurized containers 20 are generally made of a casing 21 fitted with a neck closed with a valve 30 mounted on a valve cup 35. Sometimes the valve cup 35 is attached to the casing 21 by way of a dome 22. When the valve 30 is male type, a flow restrictor 31 or stem protrudes from the valve.

The diffuser 100 comprises a base body 110 and an outlet duct 120. The base body 110 may have a cavity formed by an outer wall 111 of the base body or provided in a substantially solid body. The outlet duct 120 can be fully or partially housed within the cavity formed by the outer wall 111. The outer wall 111 can comprise concave and/or convex parts.

Pressurized containers 20 generally have a cylindrical end on which the base body 110 will be fixed. The valve's flow restrictor 31 protrudes from this end and is centred in relation to this end. The flow restrictor 31, the main body of the valve 30, and the cylindrical end of the pressurized container 20 are aligned along an axis A. In order to cooperate with the container's cylindrical end, a lower part of the base body's outer wall 111 may exhibit rotational symmetry around axis A when attached to the container.

The base body 110 may be fitted with a fastening ring 112 which allows it to be fastened either directly to the pressurized container, particularly on the casing or the valve, or by means of a collar. This fastening ring 112 may be fitted with fastening means arranged continuously or at regular intervals along the periphery of the fastening ring. The fastening means may be intended to cooperate with complementary fastening means created on the pressurized container's casing 21 or valve 30, or on the collar 23. In particular, the series of gadroons 112 regularly distributed as shown in FIG. 1B may snap behind a rolled edge 24 at the interface between the casing 21 and the valve cup 35 or between the casing 21 and the dome 22 on which the valve cup 35 is fastened. Other fastening means may be considered, such as a continuous rib, a thread for a screw connection, increased thickness of material for welding, glue for bonding, etc.

The base body wall 111 may have a finger tab opening 113 in which the finger tab 130 sits. The finger tab 130 may be attached to the rest of the base body 110 by a tongue 131 which serves as a hinge such that when pressure is exerted on the finger tab 130 towards the inside of the base body 110, thus towards the valve 30 when the diffuser 100 is fastened on the pressurized container 20, the finger tab 130 pivots around an axis which passes transversally through the tongue 131. In the example in FIGS. 1A-1B, the finger tab 130 and the corresponding finger tab opening 113 are situated near the top of the base body 110. In other embodiments, the finger tab 130 may be separate from the base body 110 and be depressed either in a vertical translational motion or in a rocking motion around a support.

An outlet opening 114 may be created in the wall 111 of the base body. The outlet opening 114 may be configured so that the product withdrawn from the pressurized container passes through it when being released from the outlet duct 120. The adjectives "front" and "rear" refer to this release of the product through the outlet opening 114, the product being released through a front section of the diffuser 100 with the rear section being opposite to it. In the example of FIGS. 1A-1B, the finger tab 130 is fastened to the rest of the base body 110 by the tongue 131 situated to the rear of the finger tab 130. In another exemplary embodiment, the finger tab may be fastened by the tongue situated to the front of the finger tab, see FIG. 4.

The base body 110 includes a connecting hole 140. The connecting hole 140 is a through hole between an outer surface of the base body 110 and an inner surface of the base body 110, and is configured to facilitate the attachment of the outlet duct 120 such that the outlet duct 120 may be fastened to the base body 110. The outlet duct 120 may be fastened to the base body 110 by joining them mechanically, by bonding, welding, and/or heat-bonding. In the example at FIGS. 1A-1B, the connecting hole 140 is located in the longitudinal cross-section plane of the base body 110, on a front part of the finger tab 130.

Due to the fastening being between the outlet duct 120 and the base body 110, these two parts of the diffuser 100 can each be made from different materials. The material for the outlet duct 120 can be selected to be compatible with the product contained in the pressurized container, whilst the material for the base body 110 does not need to satisfy this condition, but can be selected for its mechanical properties or its environmental and/or economic value, e.g., a recycled material. For example, if the diffuser 100 is to be used for a food product, the material for the outlet duct 120 may be of food grade quality, whilst this is not required of the base body 110 because it is not in contact with the product.

Depending on what fastening is used to attach the outlet duct 120 to the base body 110, materials can be selected either to be compatible or not. Possible materials for the base body 110 could include polymer materials (PE, PP, PLA, PHA, PBS), which could be either new or recycled, petroleum-based or from natural resources, biodegradable or not, including compostable or not. They could contain mineral fillers, e.g., basalt glass, and could be reinforced with mineral or vegetable fibres. Non-polymer materials, such as lignin-based materials, could be considered, e.g., cardboard, wood, materials containing textiles, or metals, etc. As a non-limiting example, polymers (PE, PP, POM, PBT, PA, etc.), which are injectable materials, or machinable materials such as metals, e.g., aluminium, steel, and especially stainless steel, could be used for the outlet duct 120.

A more detailed description of the outlet duct 120, of its positioning in relation to the base body 110 and the way it is fastened to the base body 110 can be read below with reference to FIGS. 2A-2B.

Figure 2A:
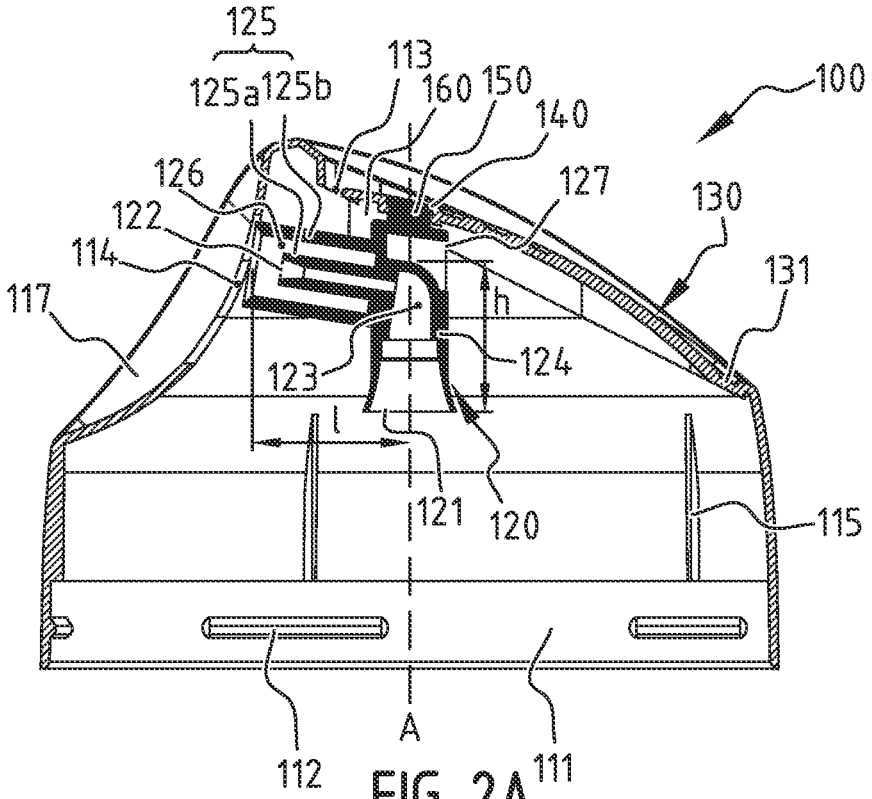
FIGS. 2A-2B show a longitudinal cross-sectional view of the diffuser and an enlargement, respectively, according to the embodiment in FIGS. 1A-1B.
Figure 2B:
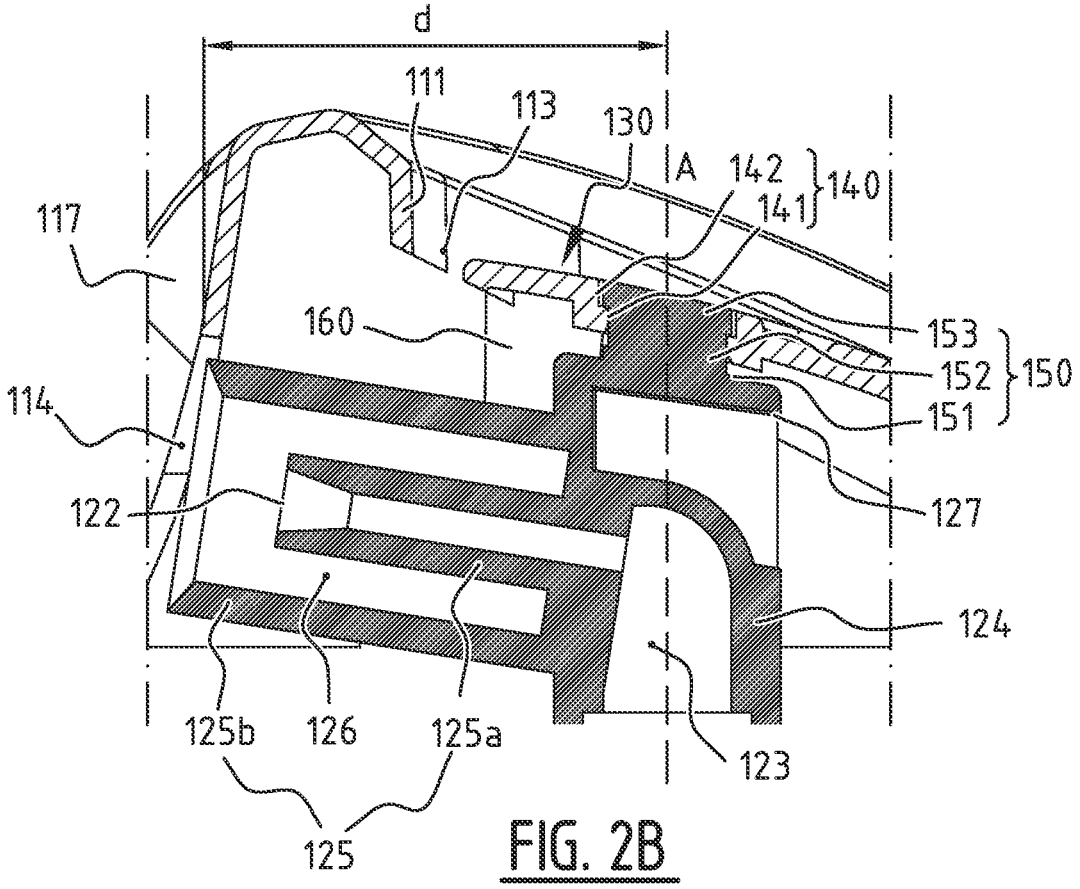

FIGS. 2A-2B respectively show a longitudinal cross-sectional view of the diffuser and an enlargement, relating to the exemplary embodiment in FIGS. 1A-1B. The diffuser 100 comprises a base body 110 and an outlet duct 120.

The outlet duct 120 placed in the base body 110 has a passage 123 between a first end 121 and a second end 122. The first end 121 is configured to cooperate with the pressurized container's valve. The second end 122 is configured for the release of the product contained in the pressurized container. When the outlet duct 120 is fastened to the base body 110, the second end 122 is oriented so as to correspond with the outlet opening 114. The second end 122 can be either fixed or floating in relation to the outlet opening 114, and is shown as floating in this example.

The outlet duct 120 has, at its first end 121, means to actuate the valve. If the valve is of female type, the first end 121 may comprise a rod intended to penetrate the valve to actuate it. If the valve is of male type, the first end 121 may be splayed to facilitate the introduction of the stem when mounting the diffuser 100 on the pressurized container.

The second end 122 of the outlet duct opens outwards and may be provided with a nozzle to improve the aerosol quality. If the product is not released in alignment with the valve, the outlet duct 120 may be divided between at least one substantially straight first section 124 and a second section 125 which is at an angle to the first. In this example, the first section 124 starts at the first end 121 and ends at the junction with the second section 125. The second section 125 starts at the junction with the first section 124 and ends at the second end 122. The at least one first section 124 and the second section 125 form the passage 123 between the first end 121 and the second end 122.

In order for a nozzle to be fitted, the second section 125 may have—towards the second end 122—a nozzle housing 126. In the example of FIGS. 2A-2B, the second section 125 consists of an inner duct 125*a* which forms a portion of the passage 123 and which is surrounded by a cylindrical wall 125*b* towards the second end 122. The annular space between the inner duct 125*a* and the cylindrical wall 125*b* forms the nozzle housing 126. If the diffuser 100 does not have a nozzle, the cylindrical wall 125*b* may not be needed.

To attach the outlet duct 120 to the base body 110, the outlet duct 120 may include a fastening portion 150. In the example of FIGS. 2A-2B, the fastening portion 150 is joined to the top of the first section 124 of the outlet duct and, when the outlet duct 120 is fastened to the base body 110, extends towards the front of the finger tab 130, coaxially to axis A. According to another embodiment, the fastening portion 150 may extend at a distance from and parallel to axis A. According to yet another embodiment, the fastening portion 150 may extend obliquely in relation to axis A.

To fasten the outlet duct 120 to the base body 110 in the embodiment of FIGS. 2A-2B, the fastening portion 150 has a part configured to cooperate with a complementary part created in the finger tab 130. The fastening portion 150 is intended to be snapped into the connecting hole 140 to mechanically join the outlet duct 120 to the base body 110.

The fastening portion 150 may include a fastening lug consisting of a substantially cylindrical rod 152 which may be attached by its first end to the outlet duct 120, and which has, at its second end, a cap 153 which has a larger cross-section than the rod 152.

The junction between the rod 152 and the rest of the outlet duct 120 may constitute a shoulder 151 at a distance from the cap 153. In this case, the fastening lug 151, 152, 153, comprises a cylinder in which an annular groove is made. The top of the cylinder corresponds to the cap 153. The annular groove forms the rod 152. The part of the cylinder opposite the cap 153 corresponds to the shoulder 151. The fastening portion 150 may be joined to the outlet duct 120 by a hollow compartment 127. In this example, the hollow compartment 127 has a parallelepiped shape so as to be simple and structurally rigid. The hollow compartment 127 can act as the shoulder 151.

To prevent the outlet duct 120 from pivoting around the fastening portion 150, which would risk the second end 122 of the outlet duct no longer being aligned with the outlet opening 114, anti-rotation means may be provided. In this example, the anti-rotation means consist of two guide tabs 160. These guide tabs 160 are situated on the inner surface of the wall 111 of the base body and extend on both sides of the second section 125 of the outlet duct from the inner surface of the finger tab and in the direction of the first end 121 of the outlet duct. The two guide tabs 160 are placed opposite each other preferably symmetrically in relation to the longitudinal plane parallel to axis A and passing through the centre of the connecting hole 140 and of the outlet opening 114. They can be spaced apart so as to enclose, or at least to fit closely around, the outlet duct 120. To facilitate the installation of the outlet duct 120, the distance between the two guide tabs 160 may widen slightly towards the first end 121 of the outlet duct, along axis A.

In another preferred embodiment, the fastening lug 151, 152, 153 may comprise an asymmetrical or polyhedral cross-section. The connecting hole 140 may comprise an asymmetrical or polyhedral cross-section corresponding to the asymmetrical or polyhedral cross-section of the fastening lug 151, 152, 153. The asymmetrical or polyhedral cross-sections of the fastening lug 151, 152, 153 and the connecting hole 140 can be selected such that, in a fastened state, any rotation of the outlet duct 120 in relation to the base body 110 is prevented.

Depending on the length of the second section 125 of the outlet duct, it can be arranged that the outlet opening 114 be brought closer to axis A, with a front portion comprising the outlet opening 114 being formed by a convex surface 117. As a result of the outlet opening 114 in the convex surface 117 being brought closer, the longitudinal dimension l between axis A and the end of the second section 125 may be made less than 15 mm, preferably less than 12.5 mm and even more preferably less than 10 mm. In order to make the outlet duct 120 even more compact, the height h of the first section 124 along axis A between the first end 121 and the top of the passage 123 may be made less than 15 mm, preferably less than 12.5 mm and even more preferably less than 10 mm.

The connecting hole 140 may be made in the base body 110 to facilitate the fastening of the outlet duct 120 to the base body. In this example, the connecting hole 140 is located on the front half of the finger tab 130 and is a through hole between an inner surface and an outer surface of the finger tab 130. The minimum distance d between a first point, said first point being a point of the connecting hole 140 on the outer surface of the finger tab 130, and a second point, said second point being a point of the outlet opening 114 on the outer surface of the base body, may be less than 12 mm, preferably less than 10 mm and even more preferably less than 8 mm.

The connecting hole 140 may be configured to receive and hold the fastening lug 151, 152, 153. The connecting hole 140 may be defined by a first portion 141 and a second portion 142. The first portion 141 may be an internal portion leading to an inner surface of the base body 110, on the inner surface of the finger tab 130 in FIGS. 2A-2B. The second portion 142 may be an external portion leading to the outer surface of the base body 110, on the outer surface of the finger tab 130 in FIGS. 2A-2B.

The first portion 141 of the connecting hole may have dimensions suitable to accommodate the fastening lug's rod 152. The second portion 142 of the connecting hole may be broader and have dimensions to accommodate the fastening lug's cap 153. Additionally, the second portion 142 and the cap 153 may be configured so that the surface of the end of the cap 153 is flush with the outer surface of the base body 110, and flush with the outer surface of the finger tab 130 in FIGS. 2A-2B. Thus, in this example, the surface of the end of the cap 153 is not perpendicular to the axis of the rod 151, but slightly tilted to follow the contour of the outer surface of the finger tab 130 around the connecting hole 140.

In another preferred embodiment, the cap 153 may protrude beyond or be recessed from the outer surface of the finger tab 130 around the connecting hole 140. Alternatively or additionally, the cap 153 and the connecting hole 140 may have cross-sections with different shapes and the cap 153 may be inserted through the connecting hole by pivoting the outlet duct 120 with respect to its final position in a fastened state.

When being attached, the outlet duct 120 may be inserted into the cavity formed by the outer wall 111 of the base body. The second end 122 of the outlet duct may be oriented towards the outlet opening 114. The fastening portion 150 is inserted into the connecting hole 140. The cap 153 of the fastening lug may be forcibly pushed through the connecting hole 140. In this example, the cap 153 passes forcibly through the first portion 141 of the connecting hole until it reaches the second portion 142 whose cross-section is sufficient to accommodate it. In this position, the rod 152 of the fastening lug is positioned in the first portion 141 of the connecting hole, and the shoulder 151 is located close to, or in contact with, the inner surface of the finger tab 130.

At the same time, the second section 125 of the outlet duct 120 may be inserted between the guide tabs 160. The guide tabs 160 can thus guide the outlet duct so that the second end 122 of the outlet duct and the base body's outlet opening 114 correspond. The fastening lug 151, 152, 153 attached through the connecting hole 140 may prevent the translation of the outlet duct 120 in relation to the finger tab 130 along axis A. The guide tabs 160 may prevent the rotation of the outlet duct 120 in relation to the base body 110 around axis A.

In another preferred embodiment, the outer surface of the finger tab 130 has reliefs to give better friction with a user's finger. The size and/or shape of the fastening lug's cap 153 may be such as to form part of these reliefs. For example, reliefs are formed by indentations on the outer surface of the finger tab, and the dimensions of the cap 153 are such that it cooperates with the connecting hole 140 to form a substantially similar indentation.

Additionally, a portion of the fastening lug 151, 152, 153, in a fastened state, may be visible from the outside of the diffuser 100, and may have a distinctive shape and/or colour which serve as a means of identification for the user. In this manner, the fastening lug 151, 152, 153 may have the dual function of identification and fastening means. The shape and/or colour of the fastening lug may indicate the type of product, the origin of the product, usage precautions of the product, a conditioning of the product, etc.

Figure 3:
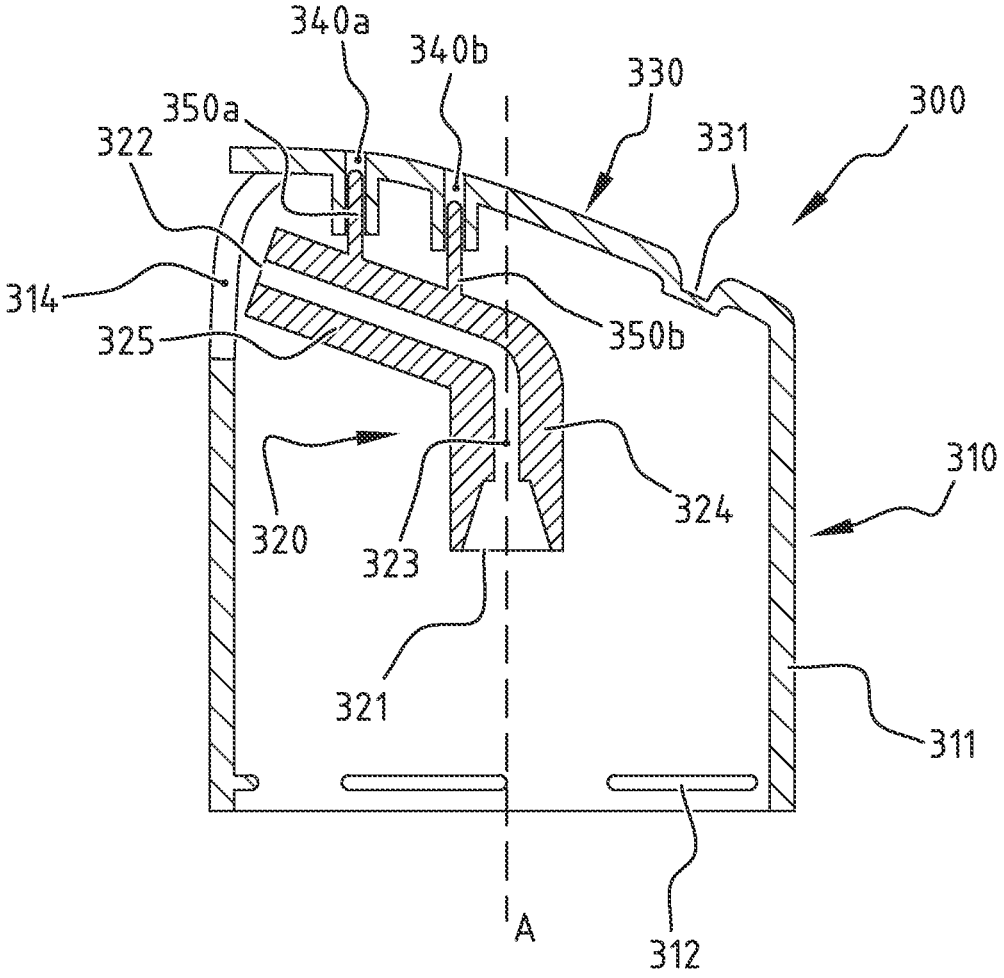
FIG. 3 shows a longitudinal cross-sectional view of the diffuser according to another embodiment of the invention.

FIG. 3 shows a longitudinal cross-sectional view of the diffuser according to another exemplary embodiment of the invention. The diffuser 300 comprises a base body 310 and an outlet duct 320.

The base body 310 may include an outer wall 311. The outer wall 311 may form a cavity, and the outlet duct 320 may be fully or partially housed in the cavity formed by the outer wall 311, shown as fully housed in this example. The outer wall 311 may comprise concave and/or convex parts.

The diffuser 300 is a diffuser for a pressurized container. The pressurized container may include a cylindrical end. In order to cooperate with the cylindrical end of the container, a lower part of the outer wall 311 of the base body may have rotational symmetry around axis A when attached to the container. The base body 310 may be configured to be attached to the pressurized container by means of a fastening ring 312. In this example, the fastening ring 312 has a series of gadroons regularly distributed along the periphery of an inner surface of the base body's outer wall 311. The fastening ring 312 may be adapted to snap behind a rolled edge of the upper end of the pressurized container.

The base body 310 may include a finger tab 330 to be depressed by the user in order to actuate the pressurized container's valve. The base body's outer wall 311 may pierced with a finger tab opening in which the finger tab 330 sits. The finger tab 330 may be attached to the rest of the base body 310 by a tongue 331 behind the finger tab 330 which serves as a hinge such that the finger tab 330 pivots around an axis which passes transversally through the tongue 331.

An outlet opening 314 may be created in the outer wall 311 of the base body. The outlet opening 314 may be configured so that the product withdrawn from the pressurized container passes through it when being released from the outlet duct 320. In the embodiment of FIG. 3, the finger tab opening is joined to the outlet opening 314 at the front of the base body 310. In another embodiment, an arch may separate the outlet opening from the finger tab opening so that the structural strength of the top of the base body 310 is reinforced.

The base body 310 includes a connecting hole 340*a*, 340*b*. In this example, the finger tab 330 is provided with two connecting holes 340*a*, 340*b*. The two connecting holes 340*a*, 340*b* may be located towards the front of the finger tab 330 in the diffuser's longitudinal plane passing through axis A. The two connecting holes 340*a*, 340*b* may be through holes between an outer surface of the finger tab 330 and an inner surface of the finger tab 330 and may extend substantially parallel to axis A. The connecting holes 340*a*, 340*b* may be defined by a cylindrical wall which extends away from an inner surface of the finger tab 330 in a direction substantially parallel to axis A. A person skilled in the art will understand that multiple variations of connecting holes 340*a*, 340*b* may be achieved by varying, for example, the number, dimensions, positioning or profile of the connecting holes.

The connecting holes 340*a*, 340*b* can be arranged to cooperate with a portion of the outlet duct 320. In this example, the outlet duct 320 may comprise two fastening portions 350*a*, 350*b* to be introduced into the corresponding connecting holes 340*a*, 340*b* so that the outlet duct 320 is fastened to the base body. The outlet duct 320 may be held by the two fastening portions 350*a*, 350*b*, introduced in the corresponding connecting holes 340*a*, 340*b* by interlocking, bonding, heat-bonding, welding, etc.

The outlet duct 320 placed in the base body 310 has a passage 323 between a first end 321 and a second end 322. The first end 321 is configured to cooperate with the pressurized container's valve. The second end 322 is configured for the release of the product contained in the pressurized container. When the outlet duct 320 is fastened to the base body 310, the second end 322 is oriented so as to correspond with the outlet opening 314. The second end 322 may be floating in relation to the outlet opening 314. The outlet duct 320 may be divided between a substantially straight first section 324 and a second section 325 which is at an angle to the first. The first section 324 may start at the first end 321 and end at the junction with the second section 325. The second section 325 may start at the junction with the first section 324 and end at the second end 322. The first section 324 and the second section 325 may form the passage 323 between the first end 321 and the second end 322.

The two fastening portions 350*a*, 350*b* of the outlet duct 320 may extend away from the second section 325 of the outlet duct 320, in a manner substantially parallel to axis A, towards the finger tab 330. When being attached, the outlet duct 320 may be inserted into the cavity formed by the wall 311 of the base body. The second end 322 of the outlet duct may be oriented towards the outlet opening 314. The fastening portions 350*a*, 350*b* for connecting the outlet duct 320 to the base body may be inserted in the corresponding connecting holes 340*a*, 340*b* before being attached to said holes by bonding, interlocking, heat-bonding or welding. As a result of the two connecting holes 340*a*, 340*b* cooperating with the two fastening portions 350*a*, 350*b* of the outlet duct, the rotation of the outlet duct 320 in relation to the base body 310 can be prevented. A person skilled in the art will understand that alternatively this rotation can be prevented by modifying the number and/or the shape of the inserted portions and of the corresponding connecting holes.

Figure 4:
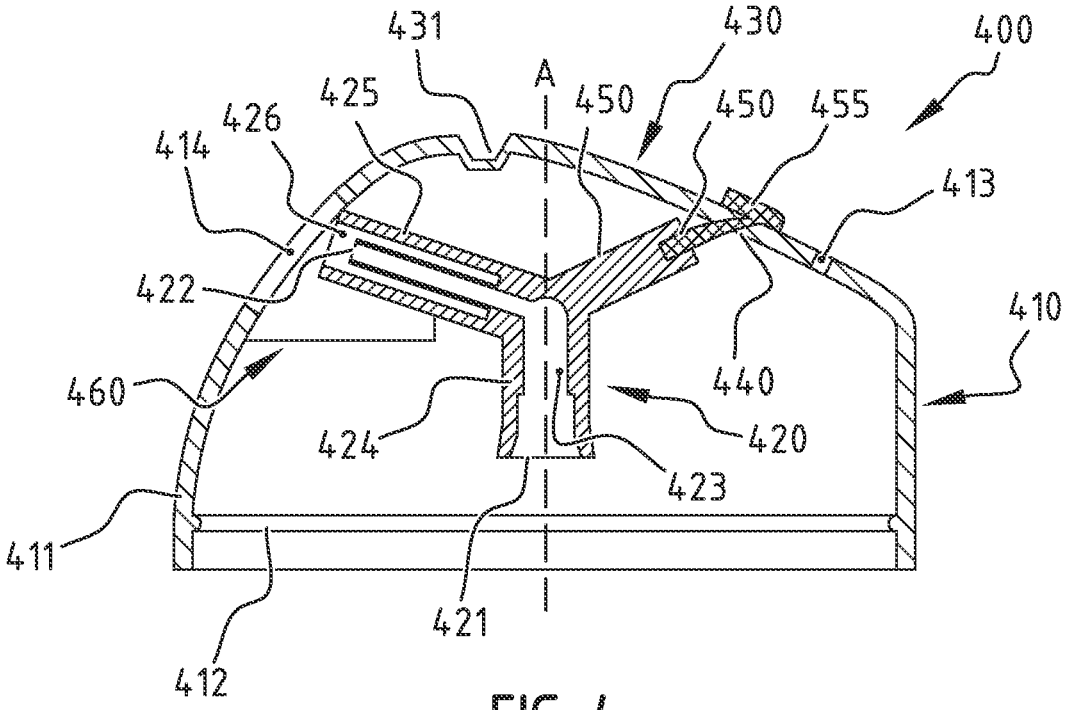
FIG. 4 shows a longitudinal cross-sectional view of the diffuser according to another embodiment of the invention.

FIG. 4 shows a longitudinal cross-sectional view of the diffuser according to another exemplary embodiment of the invention. The diffuser 400 comprises a base body 410 and an outlet duct 420.

The base body 410 may include an outer wall 411. The outer wall 411 may include concave sections forming a cavity, and the outlet duct 420 may be fully housed in the cavity formed by the outer wall 411. In order to cooperate with a cylindrical end of a pressurized container fitted with a valve, a lower part of the outer wall 411 of the base body may exhibit rotational symmetry around an axis A when attached to the container. The base body 410 may be configured to be attached to the pressurized container by means of a fastening ring 412. In this example, the fastening ring 412 is fitted with a continuous rib on the periphery of an inner surface of the outer wall 411 of the base body in such a way that the continuous rib can snap behind a rolled edge of the upper end of the pressurized container.

The base body 410 may include a finger tab 430 to be depressed by the user, said finger tab 430 being formed by a finger tab opening 413 in the outer wall 411 of the base body. The finger tab 430 may be attached to the rest of the base body 410 by a tongue 431 at the front of the finger tab 430 which serves as a hinge.

An outlet opening 414 may be created in the outer wall 411 of the base body. The outlet opening 414 may be configured so that the product withdrawn from the pressurized container passes through it when being released from the outlet duct 420.

The base body 410 includes a connecting hole 440. In this example, the finger tab 430 is provided with one connecting hole 440. The connecting hole 440 may be located towards the back of the finger tab 430 in the diffuser's longitudinal plane passing through axis A. The connecting hole 440 may be a through hole between an outer surface and an inner surface of the finger tab 430 and extend substantially towards the centre of the base body 410. The connecting hole 440 may be configured to facilitate the attachment of the outlet duct 420 to the base body 410.

The outlet duct 420 placed in the base body 410 has a passage 423 between a first end 421 and a second end 422. The first end 421 is configured to cooperate with the pressurized container's valve. The second end 422 is configured for the release of the product contained in the pressurized container. When the outlet duct 420 is fastened to the base body 410, the second end 422 is oriented so as to correspond with the outlet opening 414. The second end 422 may be floating in relation to the outlet opening 414.

The outlet duct 420 may be divided between a substantially straight first section 424 and a second section 425 which is at an angle to the first. The first section 424 and the second section 425 may create the passage 423 between the first end 421 and the second end 422. In order for a nozzle to be fitted, the second section 425 may be provided-towards the second end 422—with a nozzle housing 426. Said nozzle housing 426 may be formed by an annular space between an inner duct and the surrounding cylindrical wall of the second section 425.

To fasten the outlet duct 420 to the base body 410 in the embodiment of FIG. 4, the outlet duct 420 comprises a fastening portion 450. The fastening portion 450 may be substantially cylindrical and extend towards the back of the finger tab 430, in a fastened state, from the top of first portion 424 of the outlet duct. The fastening portion 450 may have a part which is configured to cooperate with an additional part or element so that the outlet duct 420 is fastened to the base body 410.

The fastening portion 450 may include an attachment hole 451 configured to cooperate with attaching means 455. The attachment hole 451 may be blind or through, threaded or unthreaded. The attaching means 455 may be a screw, a bolt, a rivet, etc. When being attached, the outlet duct 420 may be inserted into the cavity formed by the outer wall 411 of the base body. The second end 422 of the outlet duct may be oriented in the direction of the outlet opening 414. The second section 425 of the outlet duct 420 may be inserted between guide tabs 460. The guide tabs 460 may thus guide the outlet duct 420 so that the second end 422 of the outlet duct and the base body's outlet opening 414 correspond.

These guide tabs 460 may be situated on the inner surface of the outer wall 411 of the base body and extend on both sides of the outlet duct's outlet opening 414, and towards axis A in such a manner as to fit tightly around the second section 425 of the outlet duct. The two guide tabs 460 are located opposite each other preferably symmetrically in relation to the longitudinal plane parallel to axis A and passing through the centre of the connecting hole 440 and the outlet opening 414.

The attachment hole 451 may be aligned with the connecting hole 440. In this manner the attaching means 455 may be inserted through the connecting hole 440 to cooperate with the attachment hole 451 and fasten the outlet duct 420 to the base body 410. The connecting hole 440 may be configured such that, in a fastened state, the attaching means 455 is flush with the outer surface of the finger tab 430 around the connecting hole 440.

Figure 5:
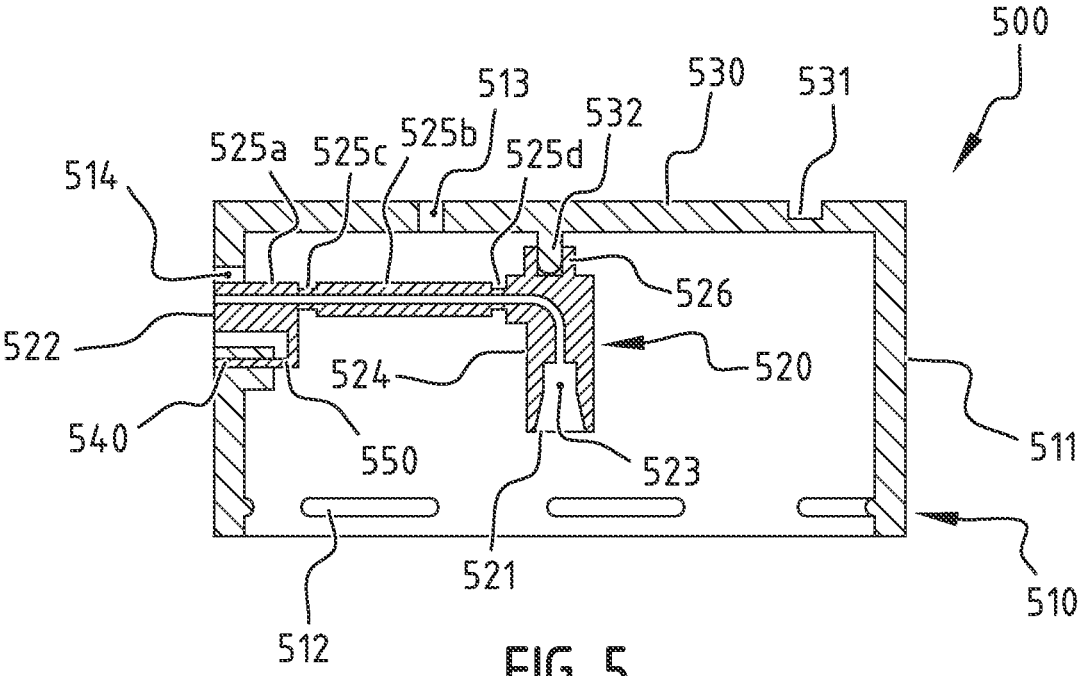
FIG. 5 shows a longitudinal cross-sectional view of the diffuser according to another embodiment of the invention.

FIG. 5 shows a longitudinal cross-sectional view of the diffuser according to another exemplary embodiment of the invention. The diffuser 500 comprises a base body 510 and an outlet duct 520.

The base body 510 may include an outer wall 511. The outer wall 511 may include concave parts forming a cavity, and the outlet duct 520 may be fully housed in the cavity formed by the outer wall 511. In this example, the outer wall 511 is substantially cylindrical. In order to cooperate with a cylindrical end of a pressurized container fitted with a valve, a lower part of the outer wall 511 of the base body may exhibit rotational symmetry around an axis A when attached to the container. The base body 510 may be configured to be attached to the pressurized container by means of a fastening ring 512. In this example, the fastening ring 512 is fitted with a series of gadroons regularly distributed along the periphery of an inner surface of the outer wall 511 of the base body in such a way that the series of gadroons can snap behind a rolled edge of the upper end of the pressurized container.

The base body 510 may include a finger tab 530 to be depressed by the user, said finger tab 530 being formed by a finger tab opening 513 in the outer wall 511 of the base body. The finger tab 530 may be attached to the rest of the base body 510 by a tongue 531, at the back of the finger tab 530, which serves as a hinge.

An outlet opening 514 may be created in the outer wall 511 of the base body. The outlet opening 514 may be configured so that the product withdrawn from the pressurized container passes through it when being released from the outlet duct 520.

The base body 510 includes a connecting hole 540. In this example, there is one connecting hole 540 through the outer wall 511 of the base body below the outlet opening 514 at a distance from the outlet opening 514. The connecting hole 540 may be located in the longitudinal plane of the diffuser passing through axis A. The connecting hole 540 be a through hole between an inner surface and an outer surface of the outer wall 511 of the base body and may extend substantially parallel to the axis of the outlet opening 514.

The outlet duct 520 placed in the base body 510 has a passage 523 between a first end 521 and a second end 522. The first end 521 is configured to cooperate with the pressurized container's valve. The second end 522 is configured for the release of the product contained in the pressurized container. When the outlet duct 520 is fastened to the base body 510, the second end 522 is oriented so as to correspond with the outlet opening 514. The second end 522 may have a fixed position in relation to the outlet opening 514.

The outlet duct 520 may be divided between a substantially straight first section 524 and a second section 525*a*, 525*b*, 525*c*, 525*d* which is substantially perpendicular to the first when the finger tab 530 is in a resting position. The first section 524 and the second section 525*a*, 525*b*, 525*c*, 525*d* may form the passage 523 between the first end 521 and the second end 522.

The second section 525*a*, 525*b*, 525*c*, 525*d* may be of an overall cylindrical shape and include, on its outer surface near the junction with the first section 525, a first notch 525*d* defining a first deformable portion of the second section 525*a*, 525*b*, 525*c*, 525*d*. The second section 525*a*, 525*b*, 525*c*, 525*d* may also comprise a second notch 525*c* located near the inner surface of the outer wall 511 of the base body defining a second deformable portion of the second section 525*a*, 525*b*, 525*c*, 525*d*. The first notch 525*d* and the second notch 525*c* may define a moving part 525*b* of the passage 523, said moving part 525*b* being able to move in accordance with the vertical movements of the first section 524. The first section 525*a*, 525*b*, 525*c*, 525*d* may include a part 525*a* which is fixed in relation to the outlet opening 514. Said fixed part 525*a* may be defined between the second notch 525*c* and the second end 522 of the outlet duct.

In order to fasten the outlet duct 520 to the base body 510 in the embodiment of FIG. 5, the outlet duct 520 includes a fastening portion 550. The fastening portion 550 may consist of a plug joined to the fixed part 525*a* of the outlet duct's second section, and extending substantially parallel to it at a distance. The fastening portion 550 can be configured to be inserted into the connecting hole 540 and keep the outlet duct 520 fastened to the base body 510 by interlocking, bonding, heat-bonding, welding, etc. A person skilled in the art will understand that the number, the shape and the dimensions of the plug may be varied depending on the desired fastening. The fastening portion 550, when the outlet duct 520 is fastened to the base body 510, may keep the second end 522 of the outlet duct in a fixed position in relation to the outlet opening. Moreover, the fastening portion 550 may prevent rotation of the outlet duct 520 relative to the base body.

The outlet duct 520 may include an attachment portion 526 to attach the outlet duct 520 to the finger tab 530. The attachment portion 526 may be configured to be attached to a fastening element 532 provided to the finger tab 530. In this example, the fastening element 532 is a plug protruding from the inner surface of the finger tab 530 extending substantially vertically towards the top of the first section 524 of the outlet duct. The attachment portion 526, in FIG. 5, is a cylindrical wall protruding from the top of the outlet duct's first section 524 extending substantially vertically towards the inner surface of the finger tab 530. The attachment portion 526 and the fastening element 532 may be designed to cooperate mechanically and to attach the finger tab 530 to the outlet duct 520 by interlocking, bonding, heat-bonding, or welding.

Preferably, the axes of the fastening element 532, the attachment portion 526, the first section 524 of the outlet duct, and the pressurized container's valve are coaxial. Pressure exerted by the user on the finger tab 530 may cause a substantially vertical displacement of the outlet duct's first section and an actuation of the pressurized container's valve. The vertical displacement of the outlet duct's first section 524 is followed by bending of the deformable sections 525*c*, 525*d* of the second section of the outlet duct 520. When the finger tab is in the actuated position, the moving part 525*b* of the second section may be at an angle to the outlet duct's first section 524. The actuation of the valve causes the product contained in the pressurized container to be released from the outlet duct's second end 522 via the outlet duct's passage 523.

Although the principles of the invention have been described above with reference to specific embodiments, it should be understood that this description is merely by way of example and should not be construed as a limitation of the scope of the invention which is defined by the accompanying claims.

The invention claimed is:

1. A diffuser for a pressurized container fitted with a valve, the diffuser comprising:

a base body including a finger tab to be depressed by a user in order to actuate the valve, and an outlet opening for the release of a product contained in the container, and an outlet duct placed in the base body, has the outlet duct having a passage between a first end, said first end being configured to cooperate with the pressurized container's valve, and a second end, said second end being configured for the release of the product contained in the pressurized container and corresponding with the outlet opening of the base body, wherein the base body comprises a connecting hole at a distance from the outlet opening, said connecting hole being a through hole between an outer surface of the base body and an inner surface of the base body, and being configured to facilitate an attachment of the outlet duct such that the outlet duct can be fastened to the base body, wherein the outlet duct is fastened mechanically to the base body through the connecting hole, wherein the outlet duct has a fastening lug, arranged in such a way that the fastening lug and the outlet duct are integrated with each other in one piece, wherein the fastening lug comprises a rod, a shoulder, and a cap connected to the outlet duct by the rod, said rod ending, opposite the cap, with the shoulder, wherein the fastening lug is configured to cooperate with the connecting hole in such a way that, in a fastened state, the inner surface of the base body and the outer surface of the base body are located between the cap and the shoulder of the fastening lug.

2. The diffuser according to claim 1, wherein the outlet duct and the base body are two separate parts, and wherein the outlet duct, when fastened to the base body, includes a section inserted into the connecting hole.

3. The diffuser according to claim 1, wherein the connecting hole is a through hole between an outer surface of the finger tab and an inner surface of the finger tab.

4. The diffuser according to claim 3, wherein the connecting hole is located on a front half of the finger tab as seen in the direction of flow of the product from the second end of the outlet duct, in the fastened state.

5. The diffuser according to claim 3, wherein a portion of the connecting hole leading to the inner surface of the finger tab is configured to be coaxial to the pressurized container's valve.

6. The diffuser according to claim 3, wherein the connecting hole extends transversely to the outer surface and/or inner surface of the finger tab.

7. The diffuser according to claim 1, wherein the connecting hole is defined by a first portion and a second portion, said first portion being an internal portion leading to the inner surface of the base body, said second portion being an external portion leading to the outer surface of the base body, and wherein the first portion and second portion of the connecting hole are configured so that, in the fastened state, the surface of the end of the fastening lug's cap is flush with the outer surface of the base body.

8. The diffuser according to claim 1, wherein the fastening lug comprises an asymmetrical or polyhedral cross-section, wherein the connecting hole comprises an asymmetrical or polyhedral cross-section corresponding to the asymmetrical or polyhedral cross-section of the fastening lug, said asymmetrical or polyhedral cross-sections of the fastening lug and the connecting hole being selected such that, in the fastened state, any rotation of the outlet duct in relation to the base body is prevented.

9. The diffuser according to claim 1, wherein the outlet duct is provided with a hollow compartment between the fastening lug and the passage between the first end and the second end.

10. The diffuser according to claim 1, wherein the second end of the outlet duct is floating in relation to the base body.

11. The diffuser according to claim 1, wherein the base body consists of a wall which forms a cavity, said wall comprising a convex front surface as seen in the direction of flow of the product from the second end of the outlet duct, in the fastened state, said convex front surface including the outlet opening which corresponds with the second end of the outlet duct, in the fastened state.

12. The diffuser according to claim 11, wherein the connecting hole is a through hole between an outer surface of the finger tab and an inner surface of the finger tab, and wherein a minimum distance between a first point, said first point being a point of the connecting hole on the outer surface of the finger tab, and a second point, said second point being a point of the outlet opening on the outer surface of the base body, is less than 12 mm.

13. The diffuser according to claim 1, wherein a portion of the fastening lug, in the fastened state, is visible from the outside of the diffuser, and has a recognisable shape and/or colour serving as a means of identification for the user.

14. The diffuser according to claim 1, wherein the connecting hole is distinct from the first end.

15. A diffuser for a pressurized container fitted with a valve, the diffuser comprising:

a base body formed by an outer wall, said based body including a finger tab to be depressed by a user in order to actuate the valve, and an outlet opening for release of a product contained in the container, and wherein a lower part of the outer wall is configured for cooperating with a cylindrical end of the container, an outlet duct placed in the base body, the outlet duct having a passage between a first end, said first end being configured to cooperate with the pressurized container's valve, and a second end, said second end being configured for the release of the product contained in the pressurized container and corresponding with the outlet opening of the base body, wherein the base body further comprises a connecting hole at a distance from the outlet opening, said connecting hole being a through hole between an outer surface of the finger tab and an inner surface of the finger tab, and being configured to facilitate an attachment of the outlet duct such that the outlet duct can be fastened to the finger tab.

16. A diffuser for a pressurized container fitted with a valve, the diffuser comprising:

a base body including a finger tab to be depressed by a user in order to actuate the valve, and an outlet opening for release of a product contained in the container, and an outlet duct placed in the base body, the outlet duct having a passage between a first end, said first end being configured to cooperate with the pressurized container's valve, and a second end, said second end being configured for the release of the product contained in the pressurized container and corresponding with the outlet opening of the base body, wherein the base body comprises a connecting hole at a distance from the outlet opening, said connecting hole being a through hole between an outer surface of the finger tab and an inner surface of the finger tab, and being configured to fasten the outlet duct to the finger tab.

* * * * *